United States Patent [19]

Mendenhall

[11] 4,189,238

[45] Feb. 19, 1980

[54] RECYCLED ASPHALT-AGGREGATE PROCESS AND APPARATUS

[76] Inventor: Robert L. Mendenhall, 1770 Industrial Rd., Las Vegas, Nev. 89102

[21] Appl. No.: 868,176

[22] Filed: Jan. 9, 1978

Related U.S. Application Data

[60] Division of Ser. No. 729,705, Oct. 5, 1976, Pat. No. 4,096,588, which is a continuation-in-part of Ser. No. 603,357, Aug. 11, 1975, Pat. No. 3,999,743.

[51] Int. Cl.[2] ..... B28C 5/46; B28C 7/10; C10C 3/00

[52] U.S. Cl. ..... 366/7; 366/8; 366/25; 106/281

[58] Field of Search ..... 366/22–25, 366/37, 235, 7; 106/281; 404/72, 80, 81; 432/13, 14, 105

[56] References Cited

U.S. PATENT DOCUMENTS

| | | | |
|---|---|---|---|
| 1,836,261 | 12/1931 | Madsen | 366/8 |
| 3,482,824 | 12/1969 | Lehman et al. | 366/7 |
| 3,845,941 | 11/1974 | Mendenhall | 366/24 |
| 3,866,888 | 2/1975 | Dydzk | 366/25 |
| 3,971,666 | 7/1976 | Mendenhall | 106/281 |
| 3,999,743 | 12/1976 | Mendenhall | 366/25 |
| 4,025,057 | 5/1977 | Shearer | 366/25 |
| 4,103,350 | 7/1978 | Brock et al. | 106/281 |
| 4,153,471 | 5/1979 | Mendenhall | 106/281 |

*Primary Examiner*—Henry C. Yuen
*Attorney, Agent, or Firm*—Seiler & Quirk

[57] ABSTRACT

In a process for recycling asphalt and aggregate containing composition, the improvement comprises separating the composition into a plurality of portions having different particle sizes, ranging from coarse to fine, introducing the particle portions into different mixing and heating drums, one of the drums being for the coarse particle portion, and one or more additional drums for smaller particle portions, and heating the particles in the respective drums with hot gases of combustion at temperatures below that which will burn the asphalt particles in each of the respective drums.

8 Claims, 1 Drawing Figure

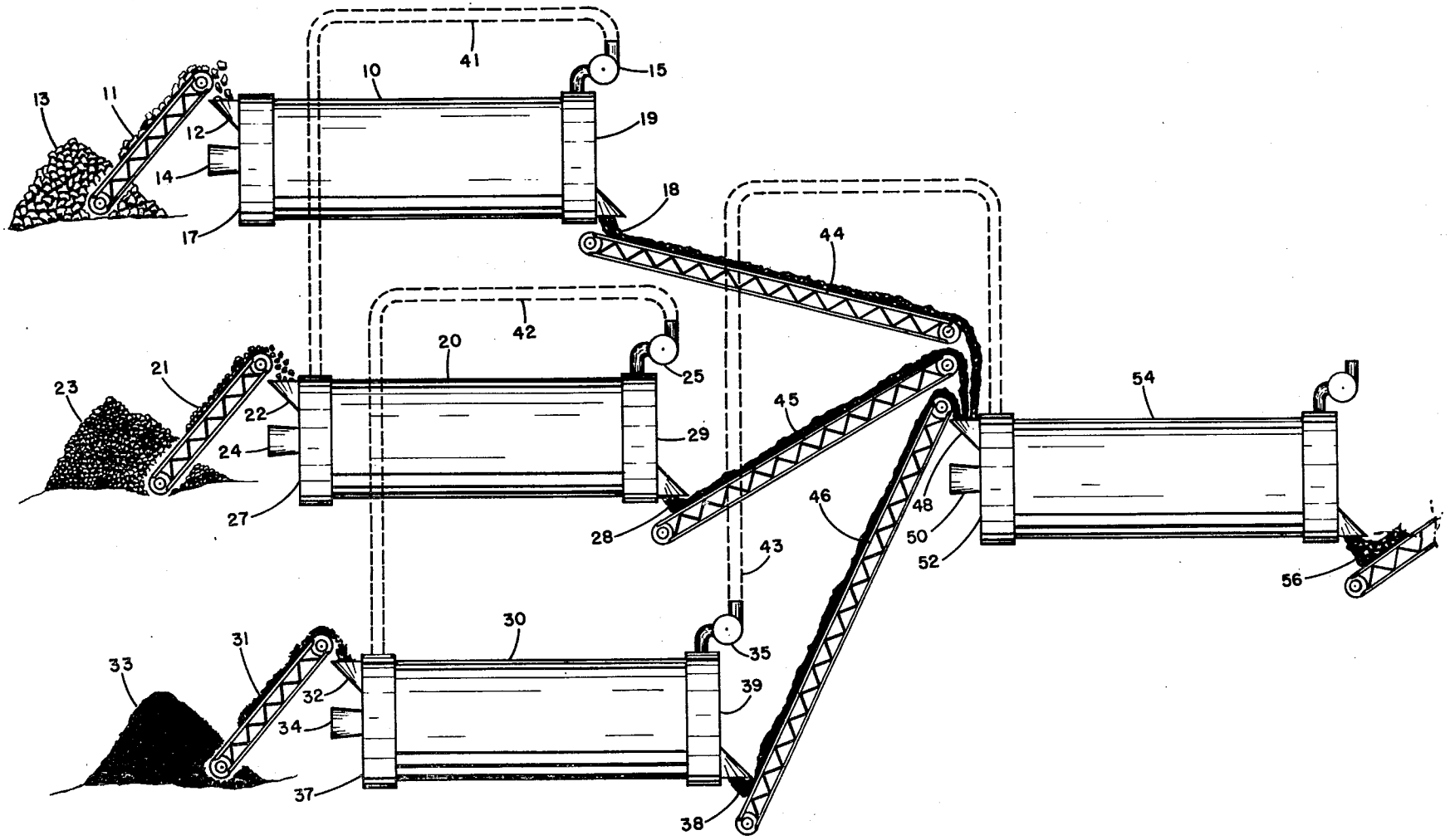
10
11
12
13
14
15
17
18
19
20
21
22
23
24
25
27
28
29
30
31
32
33
34
35
37
38
39
41
42
43
44
45
46
48
50
52
54
56

RECYCLED ASPHALT-AGGREGATE PROCESS AND APPARATUS

This is a division of application Ser. No. 729,705, filed Oct. 5, 1976, now U.S. Pat. No. 4,096,588, which is a continuation-in-part of my co-pending application Ser. No. 603,357, filed Aug. 11, 1975 now U.S. Pat. No. 3,999,743.

BACKGROUND OF THE INVENTION

Previous attempts to recycle used asphalt-aggregate compositions in conventional dryer drums have been generally unsuccessful. Recycling of used materials of this type are most desirable since the basic raw materials, asphalt and aggregate, are available in significant quantities in older roads and other "black top" surfaces that have settled, cracked and otherwise deteriorated because of long exposure to weather, heat extremes and weight loads. Gradual heating and mixing of the used materials and addition of certain compositions, especially make-up asphalt, in order to achieve proper or desirable asphalt-aggregate ratios and penetration characteristics, are required in the recycling process. Attempts to accomplish this in the conventional rotatable dryer drums in which hot flame is introduced are not successful because a portion of the particles high in asphalt content which are directly exposed to the flame and the extremely hot gases in the hottest portion of the drum are overheated thus becoming burned and coked. This not only undesirably degrades the asphalt, thereby substantially affecting the resulting product, but also causes smoke and other noxious fumes and volatiles to be driven directly into the atmosphere. The result is an inferior product and is undesirable from an air pollution standpoint. It is to the elimination of these problems that the present invention is directed.

In my aforesaid prior co-pending application, there is described an improved process and apparatus for treating asphalt and aggregate containing compositions, and especially used asphalt-aggregate composition to be recycled, comprising separating the composition into a plurality of different particle sizes ranging from coarse to fine, and introducing these individual different particle size portions into different zones of a conventional type dryer drum in which the composition is exposed to hot gases of combustion as it cascades along the rotating drum and is gravitationally directed therealong. In that invention there is particularly described a method whereby the coarse particles are introduced into the hottest end of the drum nearest the flame and hot gases of combustion whereas portions of smaller particle size ranges are introduced into one or more cooler zones within the drum away from the hottest gases of combustion and flame so as to avoid burning or degradation of the asphalt in the particles and which would result in an inferior product and the other problems set forth therein.

SUMMARY OF THE INVENTION

The present invention incorporates the concept of separating the asphalt-aggregate composition into portions of different particle size ranges between coarse and fine, and introducing these respective composition portions into a plurality of different rotatable drums into which hot gases of combustion are introduced at different temperatures so as to prevent burning of the different particle size range portions. More specifically, a coarse asphalt-aggregate composition particle size range is introduced into one drum in which the hot gases of combustion are relatively high, for example, above about 1500° F., but which temperature does not cause significant degradation of the asphalt in the particle sizes so introduced, and introducing finer particles in a second drum in which the hot gases of combustion introduced are at a lower temperature so as to avoid degradation of the asphalt in those smaller particles. Moreover, rather than utilizing two separate drums, three or more drums may be used so that the composition particles of intermediate size range are placed in a second heating drum in which the hot gases introduced are a cooler temperature than those introduced into the first drum, and introducing the portion of still finer particle sizes into a third drum in which the hot gases of combustion are cooler than both the first and second drums. The advantage of such a process is to expose the different particle size range portions of asphalt and aggregate containing compositions during the essential heating and mixing to a maximum temperature below that at which the asphalt would burn or otherwise become deteriorated. Since the coarser particles act as a greater heat "sink" than the smaller particles, the amount of heat to which the coarser particles can be exposed before asphalt degradation begins, is greater than the smaller particles, assuming exposure for the same period of time. Accordingly, the advantage of the invention in separating the composition to different particle size ranges and heating these different particle sizes at different temperatures to achieve the desired result will be evident to those skilled in the art from the following detailed description.

BRIEF DESCRIPTION OF THE DRAWING

The FIGURE is a schematic illustration of a plurality of heating and mixing drums and the process of introducing different particle sizes in the respective drums according to the invention.

DETAILED DESCRIPTION OF THE INVENTION

In recycling used asphaltic concrete compositions, it is usually first necessary to break up the old roadway, parking lot, driveway or the like into chunks or rather large pieces of the composition and then process it through a crusher and screen it. Such material will substantially pass a one inch minus sieve and may range in particle sizes from one inch to as small as even passing a No. 200 U.S. Series mesh sieve. Because the smaller particles normally have a higher asphalt content by weight than the coarser particles and because the smaller particles will become heated to a substantially greater extent than the larger particles when subjected to any specific temperature for the same period of time, it is important to avoid overheating the smaller particles so as to prevent burning, degradation, smoke, and noxious fumes and other atmospheric pollutants, and resulting in an inferior final product because of the asphalt degradation. For example, it has been found that the time required to heat the asphalt-aggregate particles to a given temperature is approximately proportional to the square of the particle size diameter. Thus, it may take only 1/16 of the time to heat a ¼ inch particle as compared to that for heating a 1 inch particle to the same temperature.

Observing now the drawing, there are shown three individual and separate rotatable dryer drums 10, 20 and 30. These dryer drums are rotatable about their elongated axes and may have the characteristics of such dryer drums well known to those skilled in the art including flights extending along the interior cylindrical surface for lifting composition as the drum turns or rotates until it falls gravitationally downwardly to the bottom of the drum. This alternate lifting and cascading of the composition will continue as composition within the drum is advanced gravitationally from the drum input end to the drum output end. The drums are provided with drive means for rotation along the elongated axis as well as means for tilting the drum, preferably so that the composition input end will be elevated from the output end whereby composition will gradually be drawn gravitationally to the output end. Such features are well understood by those skilled in the art and need not be further identified or described herein.

Conveniently, composition may be introduced into each drum via a conveyor belt apparatus 11, 21 and 31 for each of the three drums respectively, although any other suitable means introducing composition may be utilized. For example, it may be desirable to modify a dryer drum with scoops and a trough along the drum exterior as disclosed in my aforesaid prior application and further illustrated in my co-pending application Ser. No. 601,177, filed Aug. 1, 1975 U.S. Pat. No. 4,034,968, which descriptions are incorporated herein by reference. However, utilizing the convenient conveyor belt, each drum is provided with a trough or inlet chute 12, 22 and 32, respectively, into which composition particles are dropped from the conveyor belt and which troughs communicate interiorly of each drum through the end wall at the input end 17, 27 and 37 of each respective drum. Further, burners 14, 24 and 34 are also conveniently located at or adjacent the respective drum input ends and may be of any suitable conventional oil or gas burning type which will provide a flame and hot gases for direction into the drum interior through an orifice or opening suitably located in the input end wall. Such burners are well known and need not be further described. Each drum also has an output end wall 19, 29 and 39, respectively, and which wall has an opening 18, 28 and 38, respectively, through which heated and mixed composition is recovered following the heating and mixing process.

An important feature of the invention is in separating the crushed asphalt-aggregate composition into particle size portions ranging from coarse to fine. Again, such sizing and separation is described in my aforesaid copending application Ser. No. 603,357, now U.S. Pat. No. 3,999,743, and which description is incorporated herein by reference. Normally, for most recycled compositions, particle sizes will range from those passing a No. 200 U.S. Series sieve up to one inch. However, usually particles which are greater than one inch in diameter may be again crushed to further reduce the particle size. For most recycle asphalt-aggregate composition specifications, up to about 10% of the particles may be retained by a ¾ inch sieve at the coarse end while up to about 10% will pass a No. 200 U.S. Series sieve at the fine or small particle end. Accordingly, for most specifications, about 80% or more of the particles to be used in a recycled process according to the invention will be those between ¾ inch and a No. 200 U.S. Series sieve.

Where it is desirable to divide the composition particles into three portions, it may be convenient to define coarse particles as those which will be retained by a ⅜ inch sieve, fine particles as those which will pass a No. 8 U.S. Series sieve, and intermediate size particles as those passing the ⅜ inch sieve but retained by the No. 8 sieve. Such a convenient gradation or separation of particle size samples will result in those in which coarse particles may comprise between about 10 and about 55%, and preferably between about 15 and about 40%, by weight of the total composition, intermediate particles between about 15 and about 60%, and preferably between about 25 and 45%, and fine particles between about 20 and about 60%, and preferably between about 30 and 50% by weight. Such a particle size range and proportions will generally be applicable to most recycled compositions, but these are given by way of illustration only, and the invention is not to be so limited. For example, instead of the aforesaid particle size portions, for certain recycle compositions, it may be desirable to define coarse particles as those retained by a No. 4 U.S. Series sieve, intermediate particles passing the No. 4 sieve but retained by a No. 20 sieve, and fine particles as those passing a No. 20 sieve. Thus, the different particle size ranges are set forth here by way of conveniently indicating suitable particle sizes for most recycle composition, but depending on the specific type of asphaltic concrete being recycled, as well as its condition, crushing apparatus used, and lay-down product specifications, variations within the different grades may be used.

Separation into more than three particle size portions as described are normally not required, but again, the invention is not so limited and four or more particle size portions may be used. Further, for many operations, separation of the particles into two size ranges will be preferred. Conveniently, coarse particles may be those retained by a No. 4 U.S. Series sieve while fine particles are those which will pass the No. 4 sieve. Where such a separation and gradation is used, coarse particles may comprise between about 35 and 75%, by weight, and preferably between about 45 and 65%, with fine particles, of course, making up the remainder of the composition. Again, a No. 4 sieve separation point may not be desirable for all recycle compositions, and depending on the specific recycled material, and the gradation of the particle sizes, the separation point may be varied as desired. It should also be understood that although portions of particle size ranges are described as those retained or passing certain sieve sizes, in any given portion, there will be some particles outside of that range present, simply because separation techniques are not absolutely precise. However, some overlap or presence of a small proportion of particle sizes outside of a given or stated range is quite acceptable.

In treating the compositions according to the process of the invention, the FIGURE illustrates three particle size stock piles 13, 23 and 33 which may be described as coarse, intermediate and fine particle size portions, respectively. These particles are fed to their respective heating and mixing drums via the conveyor systems illustrated, and after being introduced into the drums become exposed to the hot gases of combustion. Each of the drums incorporates a burner which introduces hot gases of combustion into the respective drums. Since an important feature of the invention is to avoid burning or otherwise degrading the asphalt in the heating and mixing process in each of the drums, it is important that the maximum temperature to which the particles are exposed is less than that which would otherwise cause burning or degradation of the asphalt. Since the particles will normally pass directly through the hottest temperature zone at or near the drum end, where the heat from gases or infrared energy will normally be greatest at or near the burners, it is important that the hot zone temperature of each drum be regulated. Since it is further understood that the coarse particles may be exposed to hotter temperatures than the finer particles, assuming the same exposure time, it is desirable that the temperature of the hot gas introduced into drum 30 by burner 34 be less than that introduced into drum 20 by burner 24, which is further less than the temperature of the gas introduced into drum 10 by burner 14. In other words, as the particle size range introduced into each drum is decreased, so also is temperature decreased. Normally, for coarse particles in the size range or ranges set forth hereinabove, i.e., ⅜ inch and greater, the temperature of the hot gas introduced into the drum 10, and to which coarse particles will be initially exposed, may be above about 1500° F. Likewise, for intermediate size particles as described between No. 8 and ⅜ inch, the temperature of the gas directed into intermediate drum 20 via burner 24 may be between about 1500° F. and about 1000° F. Further, for fine particles introduced into third drum 30, the hot gas introduced into that drum and to which the particles may be initially exposed, will be between about 500° F. and about 1000° F., and preferably below about 800° F.

Where the composition is separated to two particle size portions, with the fine particles passing and coarse particles retained by a No. 4 sieve, hot gas temperatures for the coarse particles receiving drum may be above about 1000° F. and those for the fine particles receiving drum less than 1000° F., and again, preferably less than about 800° F. However, it should be appreciated that the specific temperature of the gases introduced into the respective drums will depend not only on the particle sizes introduced in that drum, but the proximity of the initially cascading particles to the hottest drum portion or burner inlet. As for regulating hot gas temperatures introduced, the burner may simply be provided with more air for decreasing the gas temperature introduced, or by enriching or decreasing the volume of combustible fuel fed to the burner.

Normally, assuming each of the drums to be approximately the same size and rotating at about the same rate, the various particle portions will be exposed to the respective hot gases for approximately the same total period of time between the input and output drum ends. However, the temperature of the product portions recovered from any one of the drums may be increased or decreased to achieve the desired composition temperature by increasing or decreasing the residence time. Thus, rather than varying the hot gas temperature introduced into the drum, so long as it is not so great as to burn or degrade the asphalt in the hottest temperature zone of the drum to which the respective particles are exposed, final composition temperatures should be regulated by increasing or decreasing the residence time. This may be accomplished by changing the tilt of the apparatus somewhat. However, residence time variation may also be achieved by incorporating an internal baffle or baffles within the drums through which composition must pass as it is drawn or directed to the output drum end. Such an apparatus modification is further disclosed in my co-pending application Ser. No. 601,176, filed Aug. 1, 1975 U.S. Pat. No. 4,066,244 and which description is incorporated herein by reference. Accordingly, regardless of which method or combination of methods are used to increase or decrease residence time, it will be evident that the desired product temperature recovered at each of the respective output ports 18, 28 and 38 may be achieved. Preferably, such temperatures will be at least about 225° F. and up to about 300° F. or so.

Since in processing used asphalt-aggregate composition which are recycled according to the invention, it is desirable to introduce make-up asphalt to restore amounts of asphalt which have been removed from the original composition through aging, weathering, etc. during use. The amount of make-up asphalt to be incorporated in any of the different particle size portions may be readily determined by analyzing the used product, and simply adding a proper amount of asphalt to achieve the asphalt concentrations of the desired final product. Moreover, it will usually be desirable to also incorporate a softening agent which will further enhance the final product so as to achieve desirable penetration and ductility characteristics. Preferably, the softening agent will comprise a petroleum hydrocarbon having at least 55% aromatics to achieve a product having a penetration of between about 25 and 300 dmm at 77° F. as described in my co-pending application Ser. No. 488,518, filed July 15, 1974, U.S. Pat. No. 4,000,000 and which description is incorporated herein by reference. The make-up asphalt and/or softening agent may be added in the mixing and heating drums 10, 20 and 30, or it may be added at other times during the processing. Normally, it is most desirable to add these materials after the composition has been heated somewhat, but below any temperatures which could cause flashing of the hydrocarbon.

Once the respective particle portions have been thoroughly mixed and heated to the desired temperatures, they are recovered at the respective drum output ends after which they are combined and blended to achieve the desired final product which is then laid down as asphaltic concrete. Such blending and mixing is conveniently accomplished in another rotatable drum 54 as illustrated in the FIGURE although a pug mill or other mixing apparatus may be used. However, if additional heating is desired, the use of a heating and mixing dryer drum apparatus which is substantially like that previously described may be used and heat may be provided by hot gases supplied by a burner 50, and with the composition particle portions each being directed to an input chute 48 via conveyors 44, 45 and 46 as illustrated. Again, the hot gases of combustion supplied by burner 50 and introduced into drum 54 should be regulated to avoid asphalt burning in a manner as previously described. Moreover, make-up asphalt and/or softening agent may conveniently be added in drum 54. After the blended product has been directed to the drum output end, it is then finally recovered through port or opening 56 as the output drum end.

Although the plurality of mixing and heating drums shown are each provided with a burner for producing hot gases of combustion in order to heat the asphalt containing particles, it may also be suitable to utilize at least a portion of the hot gases from the hotter drums for further heating the cooler drums. As illustrated, each of the drums is provided with an exhaust fan 15, 25 and 25, respectively, which fans or other means are used to pull the hot gases from the input drum end to the output drum end. Thus, such exhaust means will normally simply assist in causing a draft through the apparatus and which fans may then exhaust the hot gases of combustion into the atmosphere, although various pollution control means may also be used to treat the exhausted gases. On the other hand, according to the invention, the hot exhaust gases may be directed from one drum to another drum for further heating. Although the exhaust gas temperature of a given drum will be cooler than the hot gas temperature first introduced, it will usually still be sufficiently warm so as to provide heat to a cooler temperature drum. Accordingly, conduit 41, shown in phantom, may direct the exhaust gases from drum 10 to drum 20 as illustrated. As is also illustrated, conduit 42 may further direct hot gases of combustion from the cooler output end of drum 20 via exhaust fan 25 to input end 37 of drum 30. A conduit 43 is also illustrated for directing hot gases of combustion from output end 39 of drum 30 to input end 52 of final blending drum 54. Such conduits are simply means for further utilizing energy whereby the hot gases exhausted from the respective drum output ends to the other mixing drums which have lower temperature hot gas requirements. In addition, using such a technique the burners will further oxidize combustible hydrocarbons present in the exhaust gases thus further oxidize combustible hydrocarbons present in the exhaust gases thus further reducing atmospheric pollution.

Although the process described herein is directed primarily to the processing of used asphaltic concrete compositions containing asphalt and aggregate, it is not to be so limited. For example, there are known deposits of virgin asphalt-aggregate compositions within the United States and elsewhere which contains substantial amounts of asphalt and which mixtures resemble the used materials. Such compositions may be mined, crushed to substantially resemble the used compositions described herein including particle size ranges, etc. Accordingly, such compositions may be processed utilizing the method described herein. Moreover, although the burners are shown for introducing hot gas at the input drum ends, the invention is not so restricted. Thus, the burners may be used for supplying hot gases of combustion and infrared heat at any location within the drum, again, so long as asphalt burning is avoided. These as well as other equivalent embodiments within the purview of the invention will be evident to those skilled in the art.

I claim:

1. In a process of recycling used and crushed solid asphaltic concrete composition particles comprising a mixture of asphalt and aggregate and having at least a portion of particles passing a No. 8 U.S. Series sieve the improvement comprising heating said composition particles passing said No. 8 sieve by direct exposure to hot gases of combustion having a maximum temperature below about 1000° F.

2. The process of claim 1 including heating said composition until a composition temperature of at least about 225° F. is achieved.

3. The process of claim 2 wherein said particles are exposed to said hot gases of combustion for a time to avoid burning of the asphalt.

4. The process of claim 3 wherein the maximum temperature of the hot gases of combustion is below about 800° F.

5. In a process of recycling used and crushed solid asphaltic concrete composition particles comprising a mixture of asphalt and aggregate and having at least a portion of particles passing a No. 4 U.S. Series sieve the improvement comprising heating said composition particles passing said No. 4 sieve by direct exposure to hot gases of combustion having a maximum temperature of below about 1000° F.

6. The process of claim 5 including heating said composition until a composition temperature of at least about 225° F. is achieved.

7. The process of claim 6 wherein said particles are exposed to said hot gases of combustion for a time to avoid burning of the asphalt.

8. The process of claim 7 wherein the maximum temperature of the hot gases of combustion are below about 800° F.

* * * * *